US007928657B2

(12) United States Patent
Kyushima et al.

(10) Patent No.: US 7,928,657 B2
(45) Date of Patent: Apr. 19, 2011

(54) PHOTOMULTIPLIER

(75) Inventors: Hiroyuki Kyushima, Hamamatsu (JP); Hideki Shimoi, Hamamatsu (JP); Hiroyuki Sugiyama, Hamamatsu (JP); Hitoshi Kishita, Hamamatsu (JP); Suenori Kimura, Hamamatsu (JP); Yuji Masuda, Hamamatsu (JP); Takayuki Ohmura, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 388 days.

(21) Appl. No.: 11/921,934

(22) PCT Filed: Jun. 1, 2006

(86) PCT No.: PCT/JP2006/311008

§ 371 (c)(1),
(2), (4) Date: Dec. 11, 2007

(87) PCT Pub. No.: WO2007/017983

PCT Pub. Date: Feb. 15, 2007

(65) Prior Publication Data

US 2009/0218944 A1 Sep. 3, 2009

(30) Foreign Application Priority Data

Aug. 10, 2005 (JP) ..... P2005-232488

(51) Int. Cl.
*H01J 40/00* (2006.01)
*H01J 40/16* (2006.01)

(52) U.S. Cl. ..... 313/537; 313/532; 313/533; 313/534; 313/535; 313/103 R; 313/104; 313/105 R; 313/308 C

(58) Field of Classification Search ..... 313/532–536, 313/103 R, 104, 105 R, 308, 308 C, 537
See application file for complete search history.

(56) References Cited

U.S. PATENT DOCUMENTS

| | | | | |
|---|---|---|---|---|
| 5,264,693 | A | 11/1993 | Shimabukuro et al. | |
| 5,329,110 | A | 7/1994 | Shimabukuro et al. | |
| 5,568,013 | A | 10/1996 | Then et al. | |
| 7,049,747 | B1 | 5/2006 | Goodberlet et al. | |
| 7,294,954 | B2 | 11/2007 | Syms | |
| 2005/0151054 | A1 * | 7/2005 | Syms | 250/207 |
| 2006/0164007 | A1 * | 7/2006 | Nakamura et al. | 313/533 |

FOREIGN PATENT DOCUMENTS

| | | |
|---|---|---|
| JP | 50-22396 | 7/1975 |
| JP | 4-359855 | 12/1992 |
| JP | 5-234565 | 9/1993 |
| JP | 3078905 | 6/2000 |
| WO | WO 2005/078759 | 8/2005 |

* cited by examiner

*Primary Examiner* — Nimeshkumar D Patel
*Assistant Examiner* — Thomas A Hollweg
(74) *Attorney, Agent, or Firm* — Drinker Biddle & Reath LLP

(57) ABSTRACT

The present invention relates to a photomultiplier having a fine configuration capable of realizing stable detection accuracy. The photomultiplier has a housing whose inside is maintained vacuum, and a photocathode, an electron-multiplier section, and an anode are disposed in the housing. In particular, one or more control electrodes disposed in an internal space of the housing which surrounds the electron-multiplier section and the anode are electrically connected via one or more connection parts extending from an electron emission terminal of the electron-multiplier section. In this configuration, due to a voltage, instead of the applying between an electron entrance terminal and the electron emission terminal of the electron-multiplier section, being applied between the electron entrance terminal and the control electrodes, an electric potential gradient which is increased gradually from the photocathode side toward the anode side is formed in the electron-multiplier section, and a sufficient electric potential difference is provided between the electron emission terminal of the electron-multiplier section and the anode, which makes it possible to obtain stable detection accuracy.

8 Claims, 11 Drawing Sheets

PHOTOMULTIPLIER

TECHNICAL FIELD

The present invention relates to a photomultiplier having an electron-multiplier section that cascade-multiplies photoelectrons generated by a photocathode.

BACKGROUND ART

Conventionally, photomultipliers (PMT: Photo-Multiplier Tube) have been known as optical sensors. A photomultiplier comprises a photocathode that converts light into electrons, a focusing electrode, an electron-multiplier section, and an anode, and is constituted so as to accommodate those in a vacuum case. In such a photomultiplier, when a light is made incident into a photocathode, photoelectrons are emitted from the photocathode into a vacuum case. The photoelectrons are guided to an electron-multiplier section by a focusing electrode, and are cascade-multiplied by the electron-multiplier section. An anode outputs, as signals, electrons having reached among multiplied electrons (for example, see the following Patent Document 1 and Patent Document 2).

Patent Document 1: Japanese Patent No. 3078905 (Japanese Patent Application Laid-Open No. 5-182631)

Patent Document 2: Japanese Patent Application Laid-Open No. 4-359855

DISCLOSURE OF THE INVENTION

Problems that the Invention is to Solve

The inventors have studied the conventional photomultiplier in detail, and as a result, have found problems as follows.

That is, as optical sensors expand in application, smaller photomultipliers are desired. On the other hand, accompanying such downsizing of photomultipliers, a high-precision processing technology has been required for components constituting the aforementioned photomultipliers. In particular, when the miniaturization of components themselves is advanced, it is increasingly hard to realize an accurate layout among the components, which makes it impossible to obtain high detection accuracy, and leads to a great variation in detection accuracy of each of the manufactured photomultipliers.

Even in a situation as described above, a predetermined voltage is applied to an electron-multiplier section between an end positioned at a photocathode side (an electron entrance terminal) and an end positioned at an anode side (an electron emission terminal). At this time, in the electron-multiplier section, an electric potential gradient is formed such that cascade-multiplied electrons head from the photocathode side toward the anode side (an electric potential is increased gradually from the photocathode side toward the anode side). However, in reality, there has been a problem that, when an electric potential difference between the anode and the electron emission terminal in the electron-multiplier section is not sufficiently provided, a number of secondary electrons reaching the anode is dramatically decreased, which makes it impossible to obtain practical detection accuracy.

The present invention is made to solve the aforementioned problem, and it is an object to provide a photomultiplier having a fine configuration capable of realizing stable detection accuracy by more effectively taking out cascade-multiplied secondary electrons.

Means for Solving the Problems

A photomultiplier according to the present invention is an optical sensor which has an electron-multiplier section that cascade-multiplies photoelectrons generated by a photocathode, and depending on a layout position of the photocathode, there is a photomultiplier having a transmission type photocathode emitting photoelectrons in a direction which is the same as an incident light direction, or a photomultiplier having a reflection type photocathode emitting photoelectrons in a direction different from the incident light direction.

In concrete terms, the photomultiplier comprises a housing whose inside is maintained in a vacuum state, a photocathode accommodated in the housing, an electron-multiplier section accommodated in the housing, an anode having at least a part accommodated in the housing, and one or more control electrodes that ensures a sufficient electric potential difference between an electron emission terminal of the electron-multiplier section and the anode. The housing is constituted by a lower frame comprised of a glass material, a sidewall frame in which the electron-multiplier section and the anode are integrally etched, and an upper frame comprised of a glass material or a silicon material.

The electron-multiplier section has groove portions extending along an electron traveling direction. Each of the groove portions is defined by a pair of wall parts onto which microfabrication has been performed with an etching technology. One or more protruding portions, in which secondary electron emission surfaces for cascade-multiplying photoelectrons from the photocathode are formed on the surfaces thereof, are provided along the electron traveling direction on the respective surfaces of the pair of wall parts that define one groove portion. In this way, by providing the protruding portions on the surfaces of the wall parts on which the secondary electron emission surfaces are formed, the possibility that electrons heading toward the anode collide against the wall parts is dramatically increased, and therefore, a sufficient electron-multiplication factor can be obtained even in a fine configuration. Note that, in reality, the secondary electron emission surfaces are formed on, not only the surfaces of the protruding portions, but also the entire surface of the wall parts including the back surfaces of the protruding portions and the bottom sandwiched between the groove portions.

Particularly, in the photomultiplier according to the present invention, the one or more control electrodes are disposed in an internal space of the housing that surrounds the electron-multiplier section and the anode. Furthermore, each of these control electrodes is electrically connected to the electron emission terminal of the electron-multiplier section from which cascade-multiplied electrons are emitted, and are set to electric potentials higher than that of the electron emission terminal. Note that electric potentials of the control electrodes are preferably equal to or less than an electric potential of the anode.

In accordance with this configuration, in the electron-multiplier section, an electric potential gradient in which an electric potential is increased gradually from the photocathode side toward the anode side is formed, and a sufficient electric potential difference is ensured between the electron emission terminal in the electron-multiplier section and the anode. That is, by applying a voltage, in order to form an electric potential gradient in the groove portions of the electron-multiplier section, between the end positioned at the photocathode side of the electron-multiplier section and the control electrodes, it is possible to set an electric potential at the electron emission terminal lower than that in the conventional art. As a result, a sufficient electric potential difference can be ensured between the electron emission terminal and the anode.

Here, the control electrodes may be disposed so as to sandwich the anode along with the electron-multiplier section in a state of being connected to a plurality of wiring parts extending from the electron emission terminal of the electron-multiplier section. In this case, it suffices to prepare one control electrode. Further, it may be a configuration in which the anode is disposed in an area surrounded by the electron emission terminal of the electron-multiplier section, the plurality of wiring parts, and the control electrodes.

Furthermore, in the photomultiplier according to the present invention, the control electrodes are preferably comprised of silicon easy to be processed.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

EFFECTS OF THE INVENTION

As described above, in accordance with the present invention, by further providing control electrodes electrically connected to wiring parts extending from an electron emission terminal in an electron-multiplier section, and applying a voltage between the electron entrance terminal and the control electrodes instead of the applying between an electron entrance terminal and the electron emission terminal, it is possible to make an electric potential at the electron emission terminal lower than that in the conventional art in a state in which an electric potential gradient is formed in the electron-multiplier section. As a result, it is possible to provide a sufficient electric potential difference between the electron emission terminal in the electron-multiplier section and the anode, which makes it possible to efficiently guide secondary electrons cascade-multiplied in the electron-multiplier section to the anode (stable detection accuracy can be obtained).

DESCRIPTION OF THE REFERENCE NUMERALS

1*a*: photomultiplier; 2: upper frame; 3: sidewall frame; 4: lower frame (glass substrate); 22: photocathode; 31: electron-multiplier section; 32: anode; 42: anode terminal; and 320: control electrode.

BEST MODES FOR CARRYING OUT THE INVENTION

In the following, respective embodiments of a photomultiplier according to the present invention will be explained in detail by use of FIGS. 1 to 11. In the explanation of the drawings, constituents identical to each other will be referred to with numerals identical to each other without repeating their overlapping descriptions.

Figure 1:
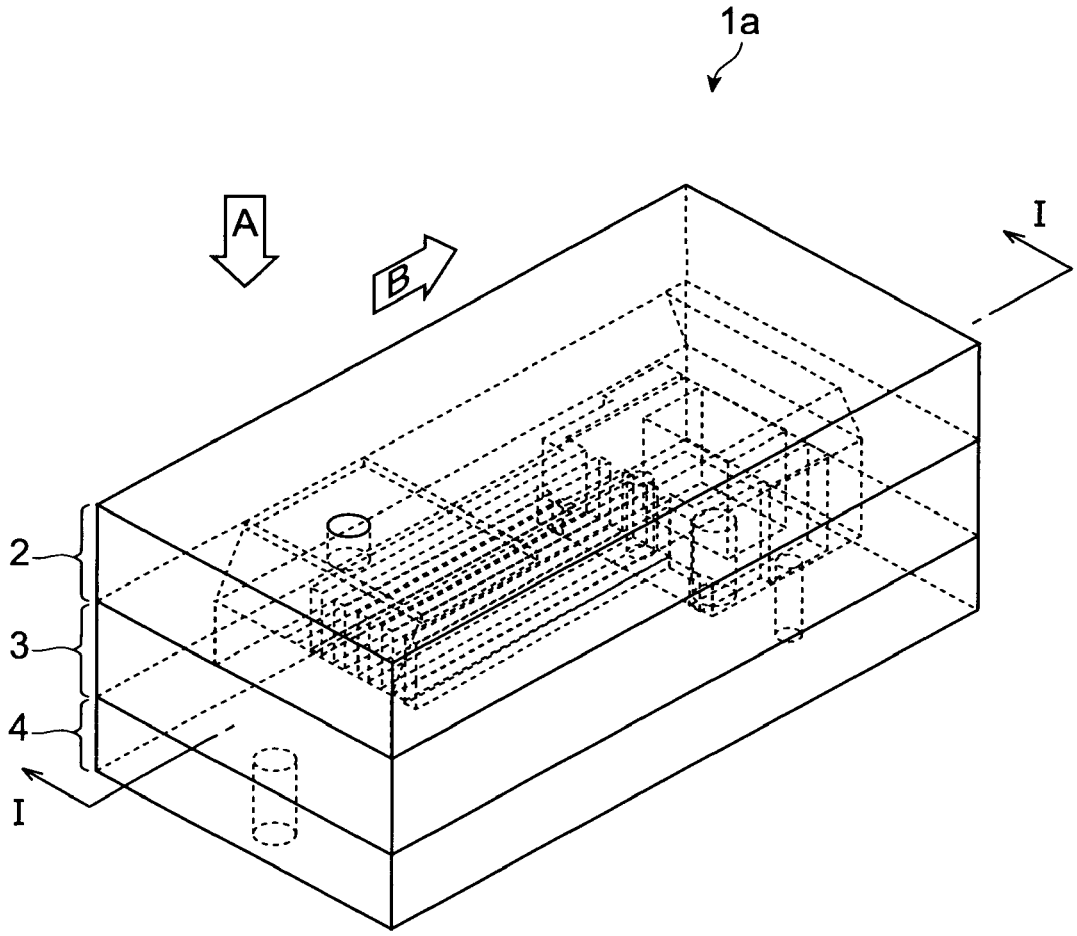
FIG. 1 is a perspective view showing a configuration of a first embodiment of a photomultiplier according to the present invention.

FIG. 1 is a perspective view showing a configuration of a first embodiment of the photomultiplier according to the present invention. A photomultiplier 1*a* shown in FIG. 1 is a photomultiplier having a transmission type photocathode, and comprises a housing that is constituted by an upper frame 2 (a glass substrate), a sidewall frame 3 (a silicon substrate), and a lower frame 4 (a glass substrate). The photomultiplier 1*a* is a photomultiplier in which an incident light direction toward the photocathode and an electron traveling direction in an electron-multiplier section cross each other, i.e., when light is made incident from a direction indicated by an arrow A in FIG. 1, photoelectrons emitted from the photocathode are made incident into the electron-multiplier section, and cascade-multiplication of secondary electrons is carried out due to the photoelectrons traveling in a direction indicated by an arrow B. Continuously, the respective components will be described.

Figure 2:
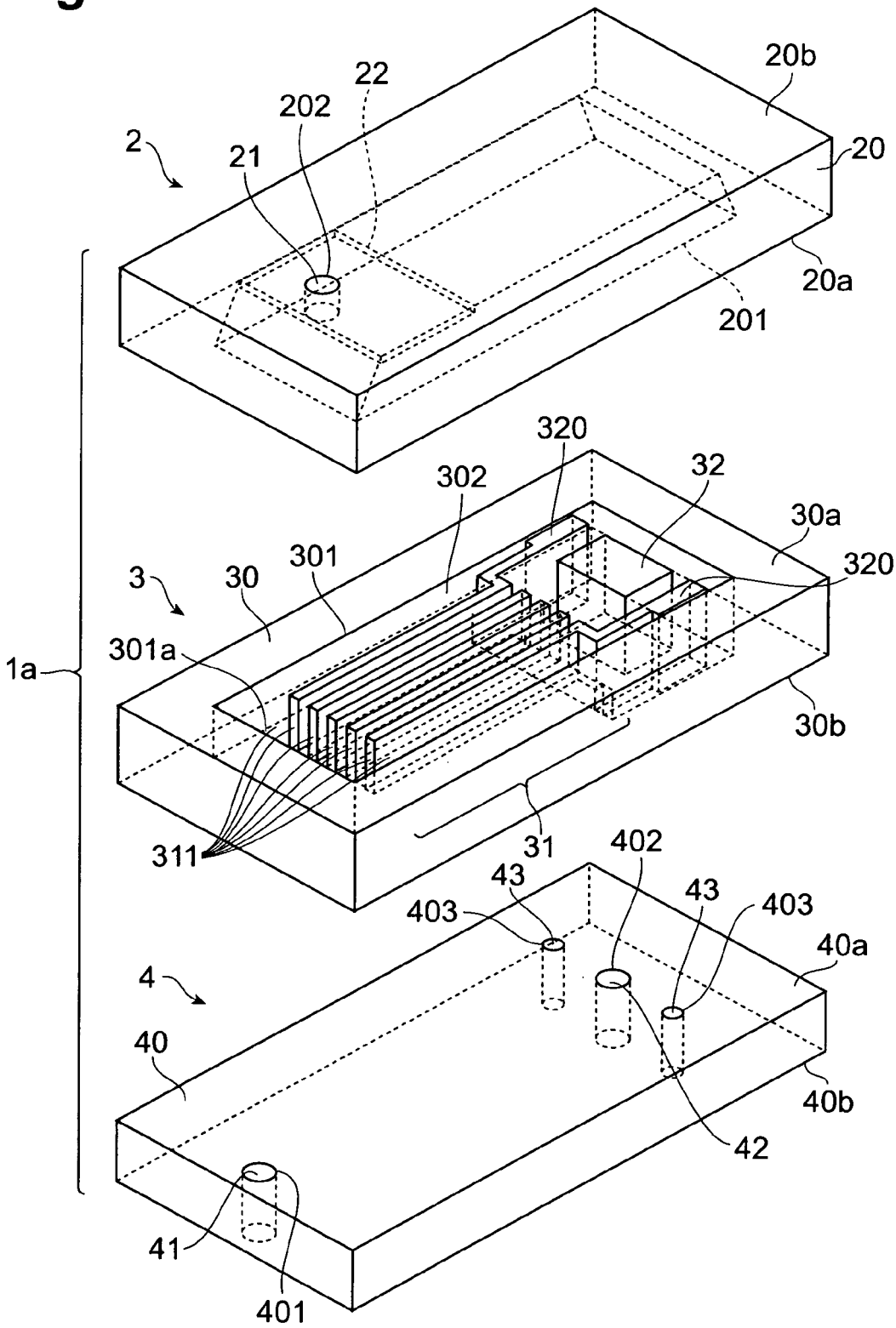
FIG. 2 is an assembly process drawing of the photomultiplier shown in FIG. 1.

FIG. 2 is a perspective view showing the photomultiplier 1*a* shown in FIG. 1 so as to be disassembled into the upper frame 2, the sidewall frame 3, and the lower frame 4. The upper frame 2 is constituted by a rectangular flat plate-shaped glass substrate 20 serving as a base material. A rectangular depressed portion is formed on a main surface 20*a* of the glass substrate 20, and the periphery of the depressed portion 201 is formed along the periphery of the glass substrate 20. A photocathode 22 is formed at the bottom of the depressed portion 201. This photocathode 22 is formed near one end in a longitudinal direction of the depressed portion 201. A hole 202 is provided to a surface 20*b* facing the main surface 20*a* of the glass substrate 20, and the hole 202 reaches the photocathode 22. A photocathode terminal 21 is disposed in the hole 202, the photocathode terminal 21 is made to electrically contact the photocathode 22. Note that, in the first embodiment, the upper frame 2 itself comprised of a glass material functions as a transmission window.

The sidewall frame 3 is constituted by a rectangular flat plate shaped silicon substrate 30 serving as a base material. A depressed portion 301 and a penetration portion 302 are formed from a main surface 30*a* of the silicon substrate 30 toward a surface 30*b* facing it. The both openings of the depressed portion 301 and the penetration portion 302 are rectangular, and the depressed portion 301 and the penetration portion 302 are coupled with one another, and the peripheries thereof are formed along the periphery of the silicon substrate 30.

An electron-multiplier section 31 is formed in the depressed portion 301. The electron-multiplier section 31 has a plurality of wall parts 311 installed upright so as to be along one another from a bottom 301*a* of the depressed portion 301. The groove portions are provided among the respective wall parts 311 in this way. Secondary electron emission surfaces formed of secondary electron emission materials are formed at the sidewalls of the wall parts 311 (sidewalls defining the respective groove portions) and the bottom 301*a*. The wall parts 311 are provided along a longitudinal direction of the depressed portion 301, and one ends thereof are disposed to be spaced by a predetermined distance from one end of the depressed portion 301, and the other ends are disposed at positions near by the penetration portion 302. Control electrodes 320 electrically connected to wiring parts extending from an electron emission terminal of the electron-multiplier section 31 are disposed along with an anode 32 in the penetration portion 302. These anode 32 and control electrodes 320 are disposed to provide a void part from the inner wall of the penetration portion 302, and are fixed to the lower frame 4 by anode joining, diffusion joining, and still further joining using a sealing material such as low melting metal (for example, indium, etc.), or the like (hereinafter, a case merely described as joining denotes any one of these joining methods).

The lower frame 4 is comprised of a rectangular flat plate-shaped glass substrate 40 serving as a base material. A hole 401, a hole 402, and holes 403 are respectively provided from a main surface 40*a* of the glass substrate 40 toward a surface 40*b* facing it. A photocathode side terminal 41, an anode terminal 42, and control electrode terminals 43 are respectively inserted into the hole 401, the hole 402, and the holes 403 to be fixed. Furthermore, the anode terminal 42 is made to electrically contact the anode 32 of the sidewall frame 3, and on the other hand, the control electrode terminals 43 are made to contact the control electrodes 320 of the sidewall frame 3.

Figure 3:
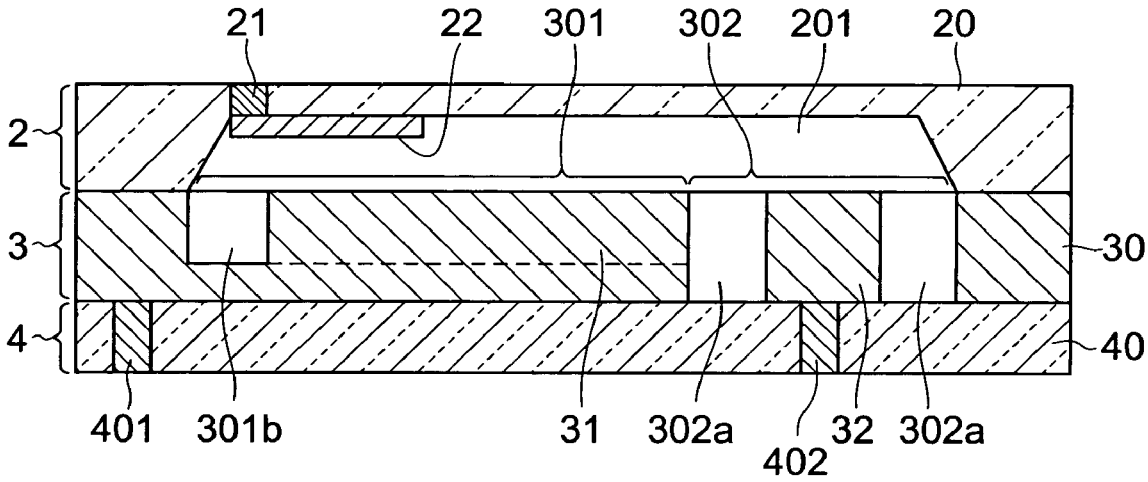
FIG. 3 is a cross-sectional view showing a configuration of the photomultiplier taken along line I-I in FIG. 1.

FIG. 3 is a cross-sectional view showing a configuration of the photomultiplier 1*a* taken along line I-I in FIG. 1. As described above, the photocathode 22 is formed at the bottom portion on the one end of the depressed portion 201 of the upper frame 2. The photocathode terminal 21 is made to electrically contact the photocathode 22, and a predetermined voltage is applied to the photocathode 22 via the photocathode terminal 21. By joining (anode joining, diffusion joining, joining with a sealing material, or the like) of the main surface 20*a* of the upper frame 2 (see FIG. 2) and the main surface 30*a* of the sidewall frame 3 (see FIG. 2), the upper frame 2 is fixed to the sidewall frame 3.

The depressed portion 301 and the penetration portion 302 of the sidewall frame 3 are disposed at the position corresponding to the depressed portion 201 of the upper frame 2. The electron-multiplier section 31 is disposed in the depressed portion 301 of the sidewall frame 3, and a void part 301*b* is formed between the wall at one end of the depressed portion 301 and the electron-multiplier section 31. In this case, one end of the electron-multiplier section 31 of the sidewall frame 3 is to be positioned directly beneath the photocathode 22 of the upper frame 2. The anode 32 is disposed in the penetration portion 302 of the sidewall frame 3. Because the anode 32 is disposed to not contact the inner wall of the penetration portion 302, the void part 302*a* is formed between the anode 32 and the penetration portion 302. Further, the anode 32 is fixed to the main surface 40*a* of the lower frame 4 (see FIG. 2) by joining.

By joining of the surface 30*b* of the sidewall frame 3 (see FIG. 2) and the main surface 40*a* of the lower frame 4 (see FIG. 2), the lower frame 4 is fixed to the sidewall frame 3. At this time, the electron-multiplier section 31 of the sidewall frame 3 as well is fixed to the lower frame 4 by joining. By joining of the upper frame 2 and the lower frame 4 respectively comprised of glass materials to the sidewall frame while sandwiching the sidewall frame 3, the housing of the photomultiplier 1*a* is obtained. Note that a space is formed inside the housing, vacuum-tight processing is performed at the time of assembling the housing constituted by the upper frame 2, the sidewall frame 3, and the lower frame 4, which maintains the inside of the housing in a vacuum state (as will hereinafter be described in detail).

Note that, although not shown in the figure, the control electrodes 320 are disposed on the right and left (in a direction perpendicular to the page space showing FIG. 3) of the anode 32, and the control electrode terminals 403 exist on the right and left of the anode terminal 402 in the frame 4 as well (see FIG. 2). Because the photocathode side terminal 401 and the control electrode terminals 403 of the lower frame 4 are respectively made to contact the silicon substrate 30 of the sidewall frame 3, it is possible to generate an electric potential difference in a longitudinal direction of the silicon substrate 30 (a direction crossing a direction in which photoelectrons are emitted from the photocathode 22, and a direction in which secondary electrons travel in the electron-multiplier section 31) by applying predetermined voltages respectively to the photocathode side terminal 401 and the control electrode terminals 403. Furthermore, because the anode terminal 402 of the lower frame 4 is made to electrically contact the anode 32 of the sidewall frame 3, electrons reaching the anode 32 can be taken out as signals.

Figure 4:
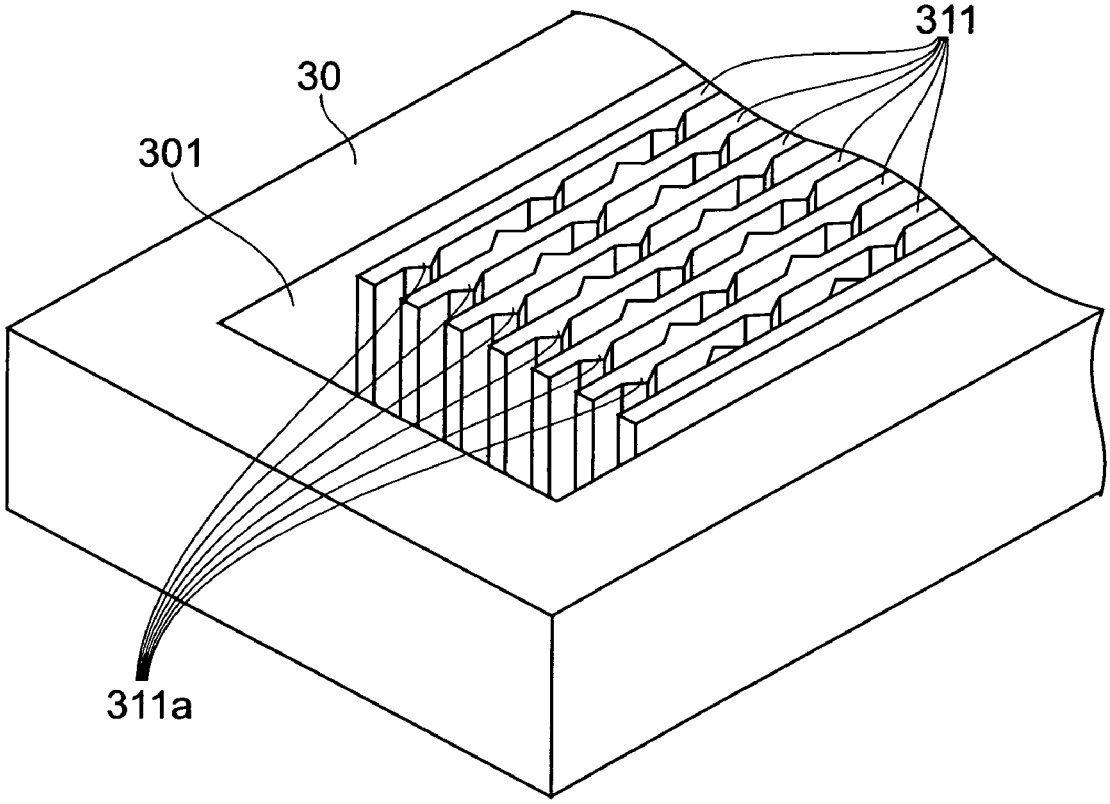
FIG. 4 is a perspective view showing a configuration of an electron-multiplier section in the photomultiplier shown in FIG. 1.

In FIG. 4, a configuration near the wall parts 311 of the sidewall frame 3 is shown. The protruding portions 311*a* are formed on the sidewalls of the wall parts 311 disposed in the depressed portion 301 of the silicon substrate 30. The protruding portions 311*a* are alternately disposed so as to be alternated on the wall parts 311 facing one another. The protruding portions 311*a* are formed evenly from the upper ends to the lower ends of the wall parts 311.

The photomultiplier 1*a* operates as follows. That is, −2000V is applied to the photocathode side terminal 401 of the lower frame 4, and 0V is applied to the control electrode terminals 403, respectively. Note that a resistance of the silicon substrate 30 is about 10 MΩ. Also, a value of resistance of the silicon substrate 30 can be adjusted by changing a volume, for example, a thickness of the silicon substrate 30. For example, a value of resistance can be increased by making a thickness of the silicon substrate thinner. Here, when light is made incident into the photocathode 22 via the upper frame 2 formed of a glass material, photoelectrons are emitted from the photocathode 22 toward the sidewall frame 3. The emitted photoelectrons reach the electron-multiplier section 31 positioned directly beneath the photocathode 22. Because an electric potential difference is generated in the longitudinal direction of the silicon substrate 30, the photoelectrons reaching the electron-multiplier section 31 head for the anode 32 side. Grooves defined by the plurality of wall parts 311 are formed in the electron-multiplier section 31. Accordingly, the photoelectrons reaching the electron-multiplier section 31 from the photocathode 22 collide against the sidewalls of the wall parts 311 and the bottom 301*a* among the wall parts 311 facing one another, and a plurality of secondary electrons are emitted. In the electron-multiplier section 31, cascade-multiplication of secondary electrons is carried out one after another, and $10^5$ to $10^7$ secondary electrons are generated per photoelectron reaching the electron-multiplier section from the photocathode. The generated secondary electrons reach the anode 32 to be taken out as signals from the anode terminal 402.

Next, layouts of the control electrodes for ensuring an electric potential difference between the electron emission terminal and the anode 32 will be described by using FIGS. 5 to 8 together with a comparative example.

Figure 5:
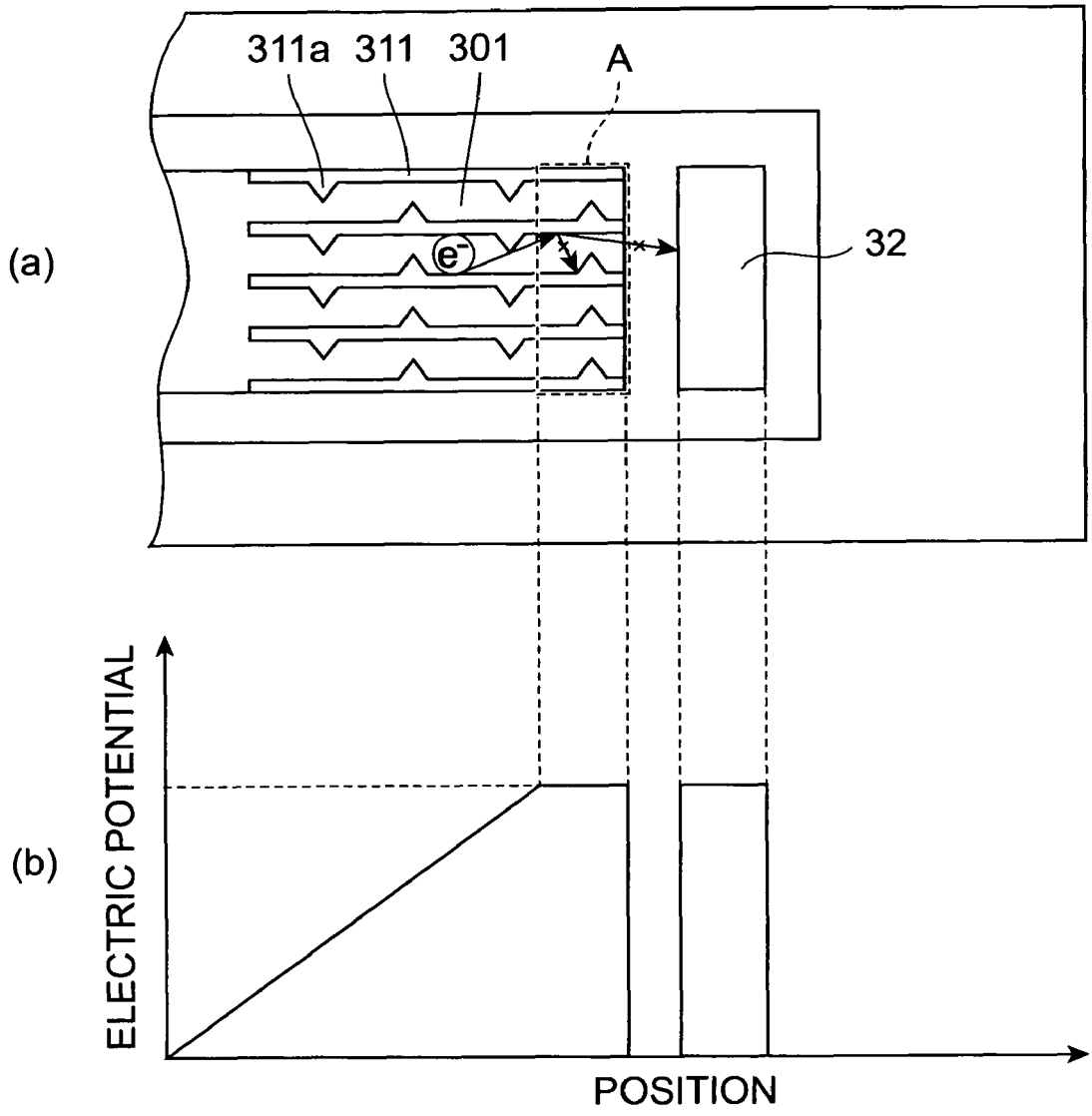
FIG. 5 illustrates diagrams showing a configuration and an electric potential gradient of a comparative example that is prepared for explanation of an effect of the photomultiplier according to the present invention.

In FIG. 5, the area (a) is a plan view of the sidewall frame 3 showing a layout of the anode 32 in the photomultiplier according to the comparative example, and the area (b) is a graph showing electric potentials (an electric potential gradient) at positions corresponding to the area (a).

In the photomultiplier according to the comparative example, a predetermined voltage is applied between the photocathode side end and the area A such that an area near the electron emission terminal of the electron-multiplier section 31 (a region shown as a back surface contact area A) is made to have the same potential as the anode 32. In this case, as shown in the area (b) of FIG. 5, an electric potential gradient in the electron-multiplier section 31 has been saturated in the vicinity of the electron emission terminal, and an electric potential difference has not been generated between the electron emission terminal and the anode 32. As a result, multiplication of secondary electrons are not sufficiently carried out in the vicinity of the electron emission terminal, and the number of electrons reaching the anode 32 as well is dramatically decreased (stable detection accuracy cannot be obtained).

Figure 6:
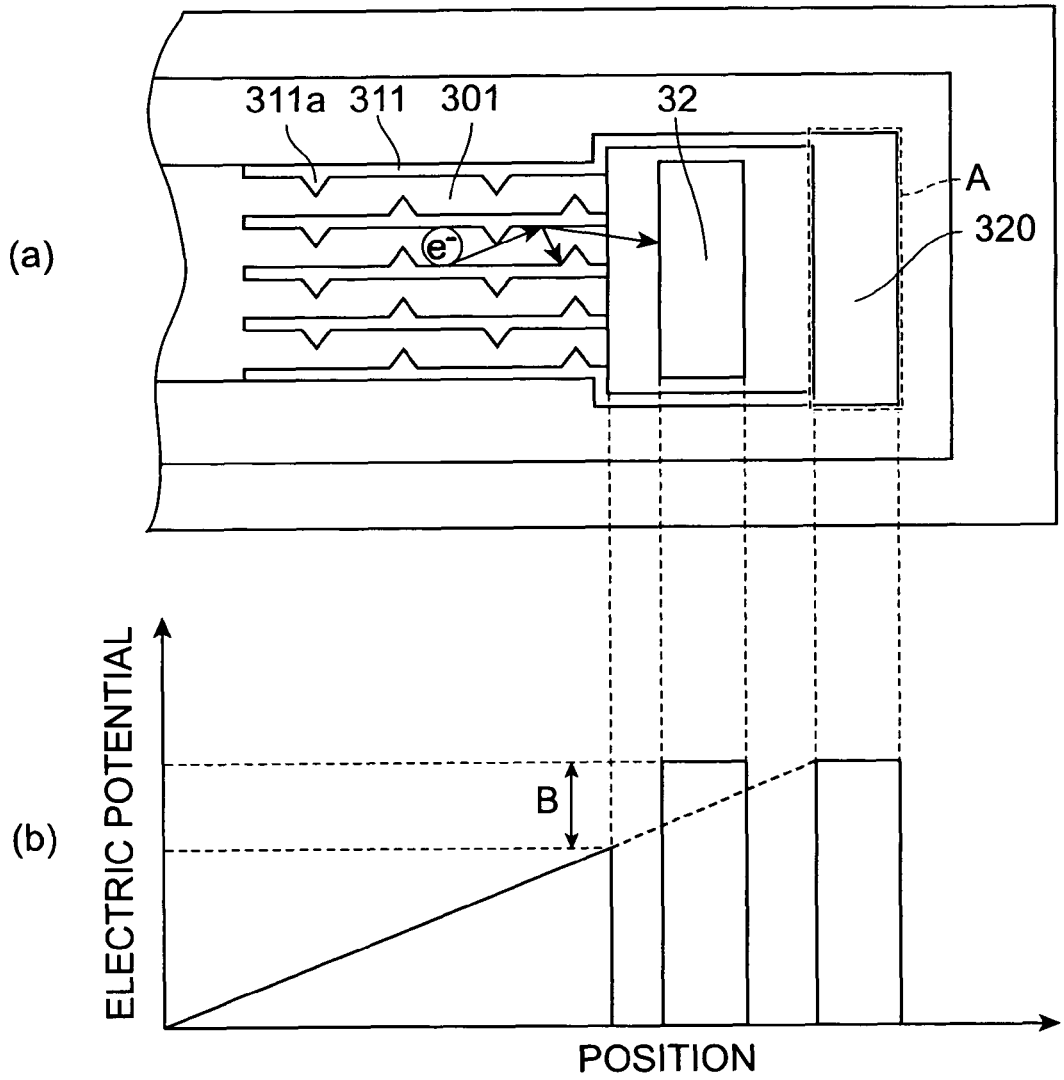
FIG. 6 illustrates diagrams for explaining a representative layout of a control electrode and an electric potential gradient in the photomultiplier according to the first embodiment.

On the other hand, in FIG. 6, the area (a) is a plan view of the sidewall frame 3 showing a first layout example of the control electrode 320 in the photomultiplier according to the present invention, and the area (b) is a graph showing electric potentials (an electric potential gradient) at positions corresponding to the area (a).

In this first layout example, the control electrode 320 is disposed so as to sandwich the anode 32 together with the electron-multiplier section 31, and is electrically connected to a plurality of wiring parts extending from the electron emission terminal of the electron-multiplier section 31 while sandwiching the anode 32. That is, in this first layout example, the anode 32 is disposed in an area surrounded by the electron-multiplier section 31, the wiring parts, and the control electrode. In addition, the control electrode 320 itself is made to be a back surface contact area A, which is set to the same electric potential as the anode 32.

In the configuration as described above, a voltage drop occurs between the electron-multiplier section 31 and the control electrode 320 as well, and an electric potential gradient is formed so as to be increased gradually toward the control electrode 320 in the electron-multiplier section 31, which ensures a sufficient electric potential difference B between the electron emission terminal and the anode 32. Furthermore, because a smooth electric potential gradient is formed in the space between the electron emission terminal of the electron-multiplier section 31 and the anode 32, it is possible for the secondary electrons emitted from the electron emission terminal to effectively reach the anode 32, and stable detection accuracy can be obtained. Also, not only by controlling a voltage to be applied, but also by adjusting lengths or cross sectional areas of the wiring parts, it is possible to easily control an electric potential gradient in the electron-multiplier section 31 and an electric potential difference B between the electron emission terminal and the anode 32.

Figure 7:
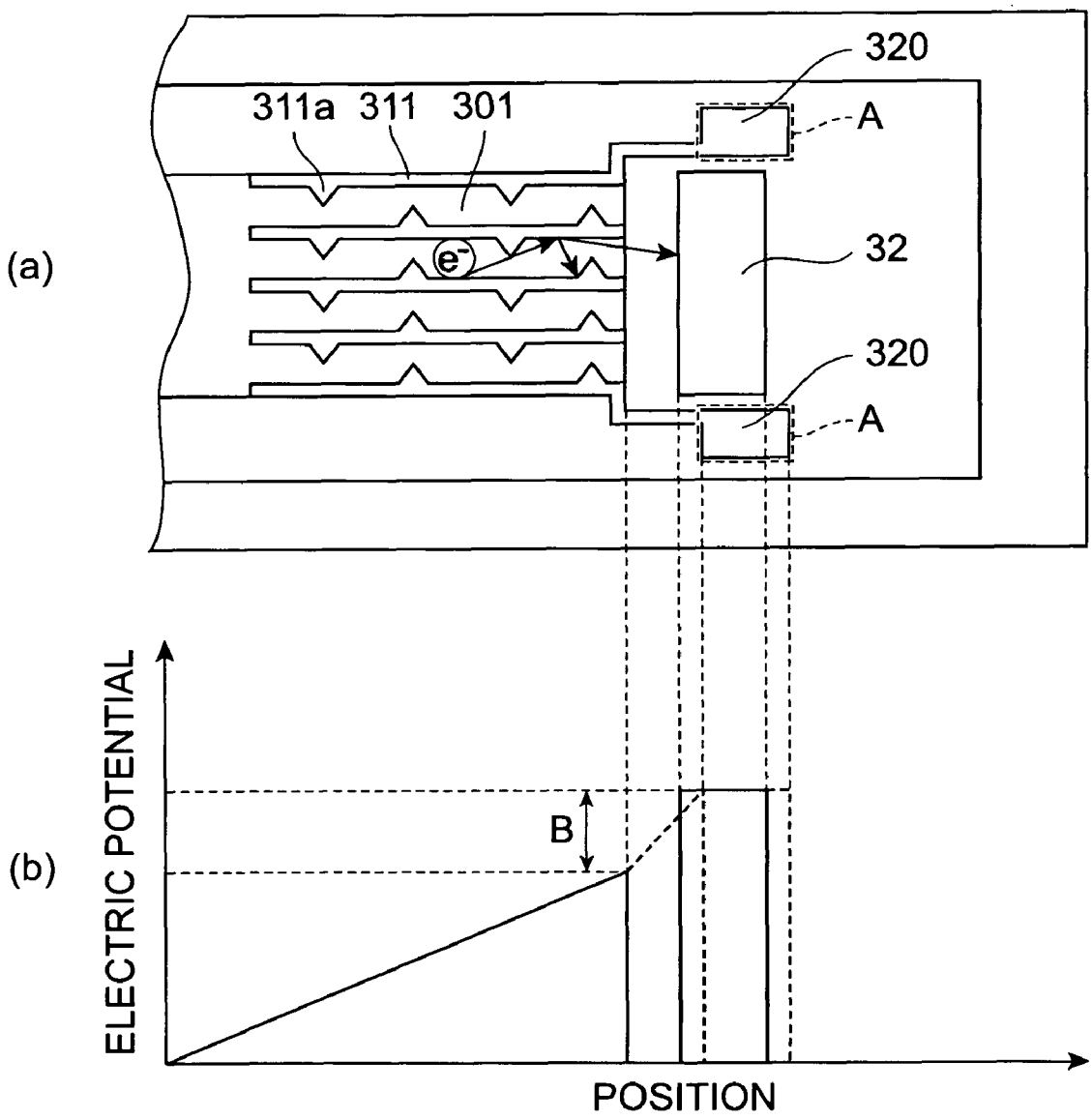
FIG. 7 illustrates diagrams for explaining another layout of control electrodes and an electric potential gradient in the photomultiplier according to the first embodiment.

In FIG. 7, the area (a) is a plan view of the sidewall frame 3 showing a second layout example of the control electrodes 320 in the photomultiplier according to the present invention, and the area (b) is a graph showing electric potentials (an electric potential gradient) at positions corresponding to the area (a).

In the second layout example, the control electrodes 320 are disposed on the right and left of the anode 32 while sandwiching the anode 32, and are electrically connected to a plurality of the respective wiring parts extending from the electron emission terminal of the electron-multiplier section 31. That is, in the second layout example, the control electrodes 320 themselves are made to be back surface contact areas A, which are set to the same electric potential as the anode 32.

In the configuration as described above as well, in the same way as in the first layout example, a smooth electric potential gradient is formed to head for the control electrodes 320 in the electron-multiplier section 31, which ensures a sufficient electric potential difference B between the electron emission terminal and the anode 32. Furthermore, because a smooth electric potential gradient is formed in the space between the electron emission terminal of the electron-multiplier section 31 and the anode 32, it is possible for the secondary electrons emitted from the electron emission terminal to effectively reach the anode 32, and stable detection accuracy can be obtained. In addition, not only by controlling a voltage to be applied, but also by adjusting lengths or cross sectional areas of the wiring parts, it is possible to easily control an electric potential gradient in the electron-multiplier section 31 and an electric potential difference B between the electron emission terminal and the anode 32.

Figure 8:
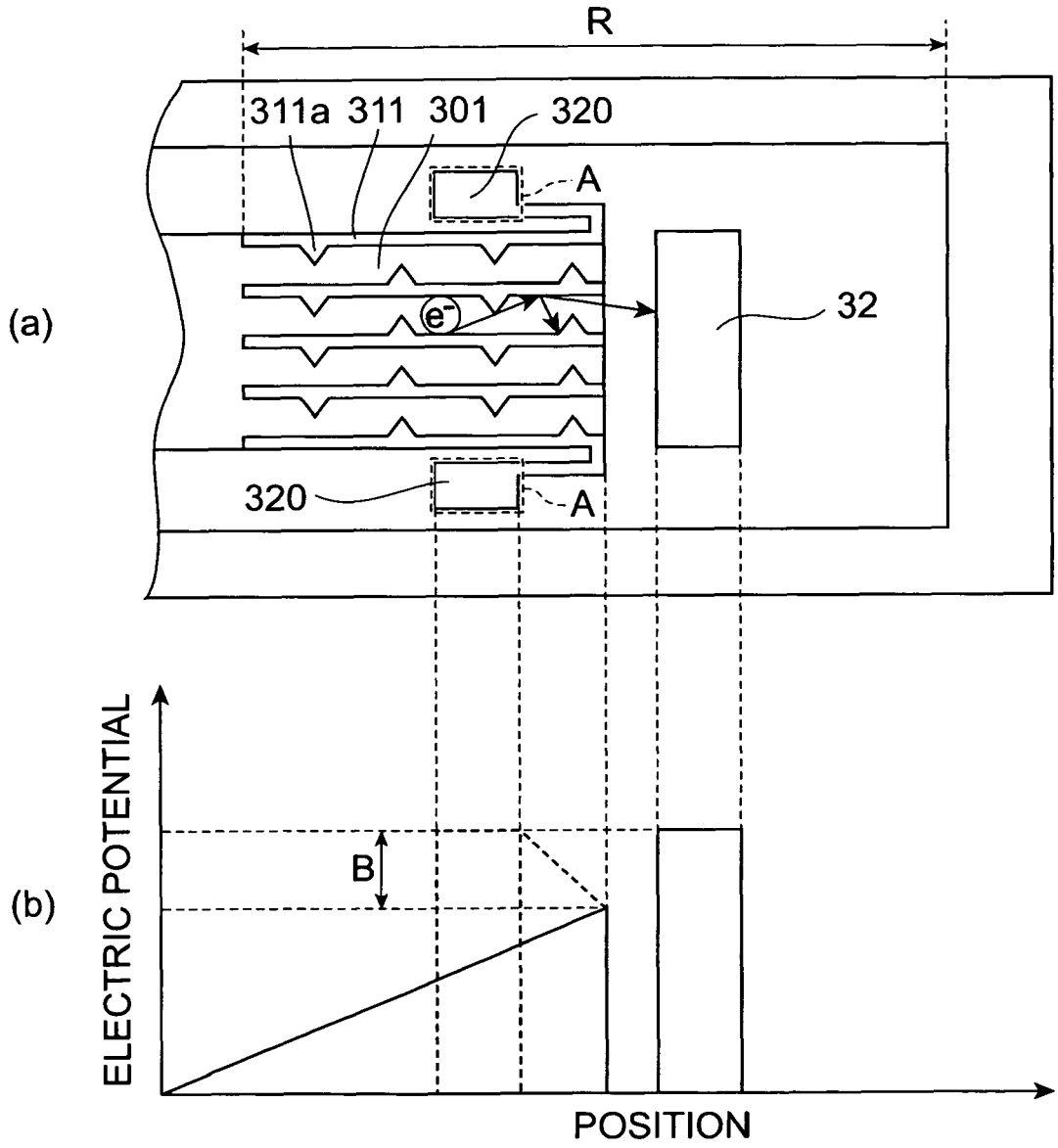
FIG. 8 illustrates diagrams for explaining yet another layout of control electrodes and an electric potential gradient in the photomultiplier according to the first embodiment.

On the other hand, the layout positions of the control electrodes 320 are not limited to the periphery of the anode 32 as described above. In FIG. 8, the area (a) is a plan view of the sidewall frame 3 showing a third layout example of the control electrodes 320 in the photomultiplier according to the present invention, and the area (b) is a graph showing electric potentials (an electric potential gradient) at positions corresponding to the area (a).

In the third layout example, the control electrodes 320 are disposed, not on the right and left of the anode 32, but on the right and left of the electron-multiplier section 31 so as to sandwich the electron-multiplier section 31. At this time, the control electrodes 320 are electrically connected to a plurality of the respective wiring parts extending from the electron emission terminal of the electron-multiplier section 31. In the third layout example, the control electrodes 320 themselves are made to be back surface contact areas A, which are set to the same electric potential as the anode 32.

In the configuration as described above as well, a smooth electric potential gradient is formed so as to head toward the control electrodes 320 in the electron-multiplier section 31, which ensures a sufficient electric potential difference B between the electron emission terminal and the anode 32. Furthermore, because an electric potential gradient is formed in the space between the electron emission terminal of the electron-multiplier section 31 and the anode 32, it is possible for the secondary electrons emitted from the electron emission terminal to effectively reach the anode 32, and stable detection accuracy can be obtained. In addition, not only by controlling a voltage to be applied, but also by adjusting lengths or cross sectional areas of the wiring parts, it is possible to easily control an electric potential gradient in the electron-multiplier section 31 and an electric potential difference B between the electron emission terminal and the anode 32.

Note that, in the above-described embodiment, the photomultiplier having a transmission type photocathode has been described. However, the photomultiplier according to the present invention may have a reflection type photocathode. For example, by forming a photocathode on the end opposite the anode side terminal in the electron-multiplier section 31, a photomultiplier having a reflection type photocathode can be obtained. Furthermore, by forming an inclined surface facing the anode side at an end side opposite the anode side of the electron-multiplier section 31, and by forming a photocathode on the inclined surface, a reflection type photomultiplier can be obtained. In either configuration, it is possible to obtain a photomultiplier having a reflection type photocathode in a state of having other configurations which are the same as those of the above-described photomultiplier 1*a*.

Also, in the above-described embodiment, the electron-multiplier section 31 disposed in the housing is formed integrally so as to contact with the silicon substrate 30 constituting the sidewall frame 3. However, in a state in which the sidewall frame 3 and the electron-multiplier section 31 contact with one another in this way, there is a possibility that the electron-multiplier section 31 is under the influence of external noise via the sidewall frame 3, which deteriorates detection accuracy. Then, the electron-multiplier section 31 and the anode 32 formed integrally with the sidewall frame 3 may be respectively disposed in the glass substrate 40 (the lower frame 4) so as to be spaced by a predetermined distance from the sidewall frame 3. In concrete terms, the void part 301*b* is made to be a penetration portion, and the photocathode side terminal 401 is disposed to electrically contact with the photocathode side end of the electron-multiplier section 31.

Furthermore, in the above-described embodiment, the upper frame 2 constituting a part of the housing is constituted by the glass substrate 20, and the glass substrate 20 itself functions as a transmission window. However, the upper frame 2 may be constituted by a silicon substrate. In this case, a transmission window is formed at any one of the upper frame 2 and the sidewall frame 3. As a method for forming a transmission window, for example, etching is carried out onto the both surfaces of an SOI (Silicon On Insulator) substrate in which a spatter glass substrate is sandwiched from the both sides by silicon substrates, and an exposed part of the spatter glass substrate can be utilized as a transmission window. Furthermore, a columnar or mesh pattern may be formed in several μm on a silicon substrate, and this portion may be thermally oxidized to be glass. In addition, etching may be carried out such that a silicon substrate of an area to be formed as a transmission window is made to have a thickness of about several μm, and this may be thermally oxidized to be glass. In this case, etching may be carried out from the both surfaces of the silicon substrate, or etching may be carried out only from one side.

Next, one example of a method for manufacturing the photomultiplier 1*a* shown in FIG. 1 will be explained. In a case of manufacturing the photomultiplier, a silicon substrate of 4 inches in diameter (a constituent material of the sidewall frame 3 in FIG. 2) and two glass substrates of the same shape (constituent materials of the upper frame 2 and the lower frame 4 in FIG. 2) are prepared. Processes which will be hereinafter described are performed onto those of each minute area (for example, several millimeters square). After the processes which will be hereinafter described are completed, they are divided into each area, which completes the photomultiplier. Continuously, a method for the processes will be described by use of FIGS. 9 and 10.

Figure 9:
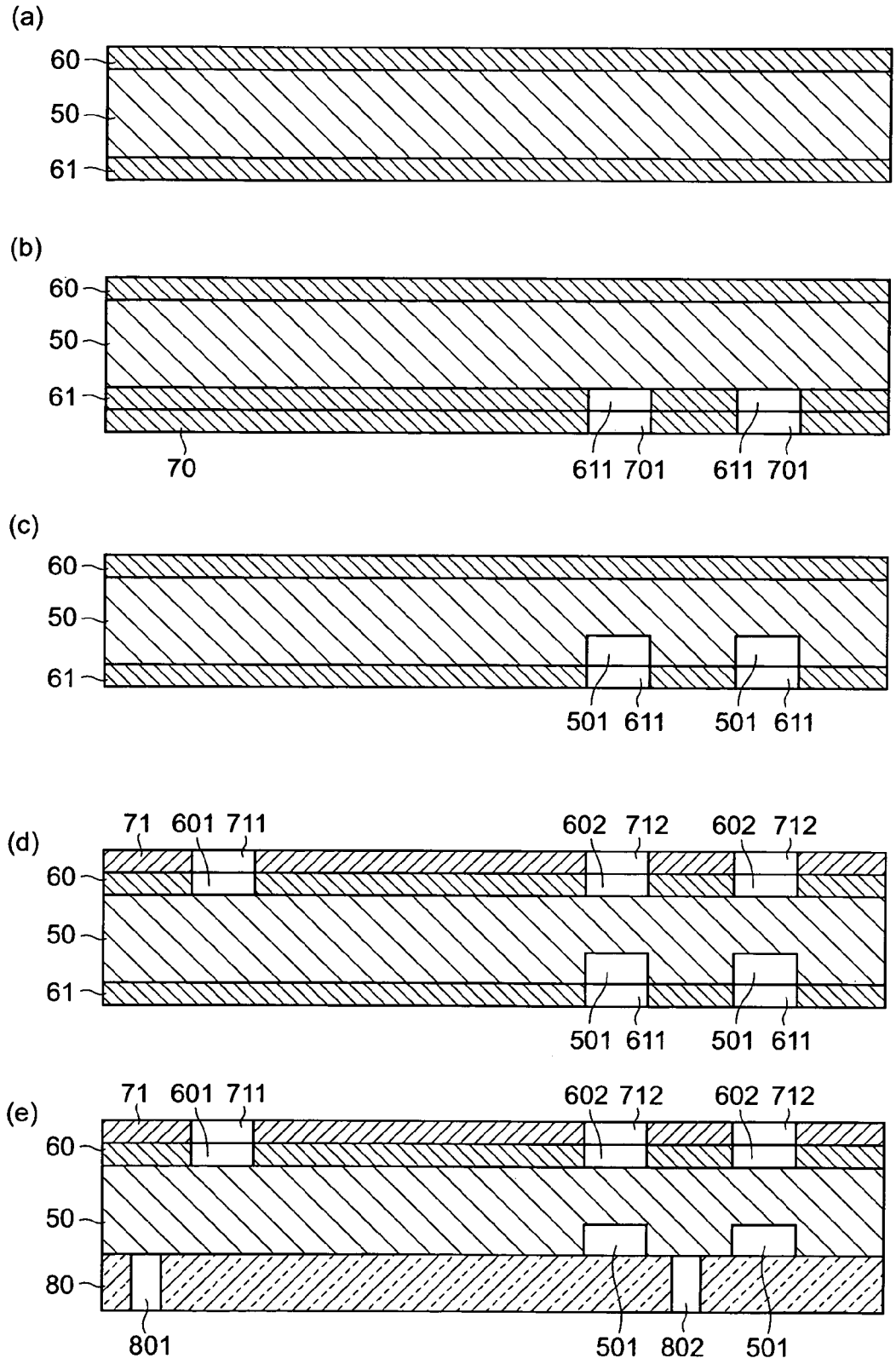
FIG. 9 illustrates diagrams for explaining manufacturing processes for the photomultiplier shown in FIG. 1 (part 1).

First, as shown in the area (a) of FIG. 9, a silicon substrate 50 (corresponding to the sidewall frame 3) with a thickness of 0.3 mm and a specific resistance of 30 kΩ·cm is prepared. A silicon thermally-oxidized film 60 and a silicon thermally-oxidized film 61 are respectively formed on the both surfaces of the silicon substrate 50. The silicon thermally-oxidized film 60 and the silicon thermally-oxidized film 61 function as masks at the time of a DEEP-RIE (Reactive Ion Etching) process. Next, as shown in the area (b) of FIG. 9, a photoresist film 70 is formed on the back surface side of the silicon substrate 50. Removed portions 701 corresponding to the voids between the penetration portion 302 and the anode 32 in FIG. 2 are formed in the photoresist film 70. When etching onto the silicon thermally-oxidized film 61 is carried out in this state, removed portions 611 corresponding to the void parts between the penetration portion 302 and the anode 32 in FIG. 2 are formed. Note that, although now shown in the figure, at this time, the same processing is performed onto other penetration portions such as regions corresponding to the control electrodes 320 and the wiring parts in FIG. 2.

After the photoresist film 70 is removed from the state shown in the area (b) of FIG. 9, a DEEP-RIE process is performed. As shown in the area (c) of FIG. 9, void part 501 corresponding to the voids between the penetration portion 302 and the anode 32 in FIG. 2 are formed in the silicon substrate 50. Next, as shown in the area (d) of FIG. 9, a photoresist film 71 is formed on the surface side of the silicon substrate 50. A removed portion 711 corresponding to the void between the wall parts 311 and the depressed portion 301 in FIG. 2, removed portions 712 corresponding to the voids between the penetration portion 302 and the anode 32 in FIG. 2, and removed portions (not shown) corresponding to the grooves among the wall parts 311 in FIG. 2 are formed in the photoresist film 71. When etching onto the silicon thermally-oxidized film 60 is carried out in this state, a removed portion 601 corresponding to the void between the wall parts 311 and the depressed portion 301 in FIG. 2, removed portions 602 corresponding to the voids between the penetration portion 302 and the anode 32 in FIG. 2, and removed portions (not shown) corresponding to the grooves among the wall parts 311 in FIG. 2 are formed.

After the silicon thermally-oxidized film 61 is removed from the state shown in the area (d) of FIG. 9, anode joining of a glass substrate 80 (corresponding to the lower frame 4) onto the back surface side of the silicon substrate 50 is carried out (see the area (e) of FIG. 9). A hole 801 corresponding to the hole 401 in FIG. 2 and a hole 802 corresponding to the hole 402 in FIG. 2 are respectively processed in advance in the glass substrate 80. Note that, although not shown in the figure, portions which will be the control electrodes 320 are formed on the right and left (in a direction perpendicular to the page space showing FIG. 9) of a portion which will be the anode 32, and holes 803 corresponding to the holes 403 in FIG. 2 are formed in advance on the right and left of the hole 802. Next, a DEEP-RIE process is performed on the surface side of the silicon substrate 50. The photoresist film 71 functions as a mask material at the time of a DEEP-RIE process, which makes it possible to process at a high aspect ratio. After the DEEP-RIE process, the photoresist film 71 and the silicon thermally-oxidized film 61 are removed. As shown in the area (a) of FIG. 10, by forming penetration portions reaching the glass substrate 80 with respect to the portions onto which the process for the void parts 501 has been performed in advance from the back surface, an island shaped portion 502 corresponding to the anode 32 in FIG. 2, a configuration (not shown) corresponding to the control electrodes 320 and the wiring parts in FIG. 2, and the like are respectively formed. This island shaped portion 502 corresponding to the anode 32 is fixed to the glass substrate 80 by anode joining. Further, at the time of the DEEP-RIE process, groove portions 51 corresponding to the grooves among the wall parts 311 in FIG. 2 and a depressed portion 503 corresponding to the void between the wall parts 311 and the depressed portion 301 in FIG. 2 as well are formed. Here, secondary electron emission surfaces are formed on the sidewalls of the groove portions 51 and the bottom 301*a*.

Figure 10:
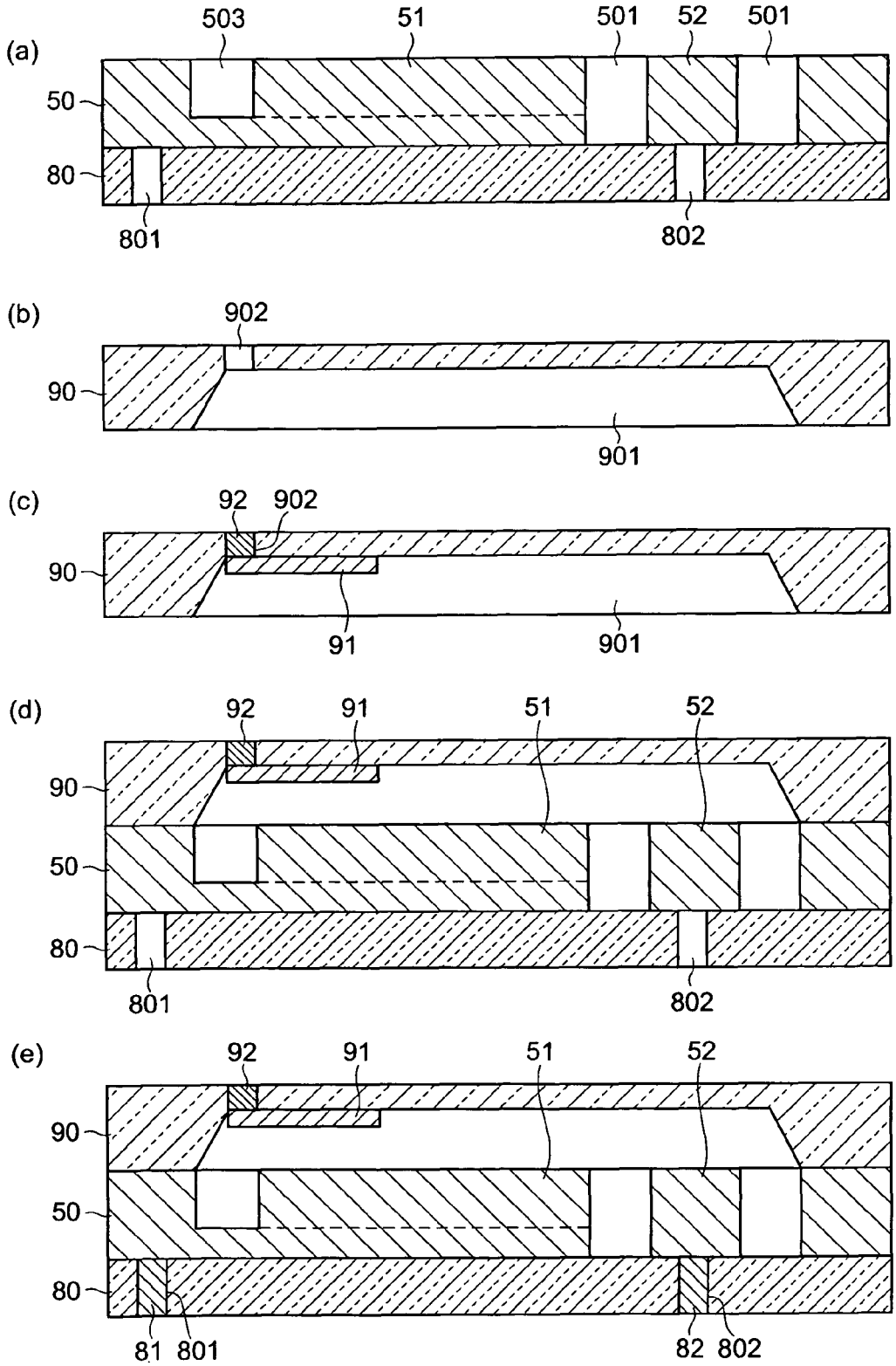
FIG. 10 illustrates diagrams for explanation of manufacturing processes for the photomultiplier shown in FIG. 1 (part 2).

Next, as shown in the area (b) of FIG. 10, a glass substrate 90 corresponding to the upper frame 2 is prepared. A depressed portion 901 (corresponding to the depressed portion 201 in FIG. 2) is formed by a spot-facing process in the glass substrate 90, and a hole 902 (corresponding to the hole 202 in FIG. 2) is formed so as to reach the depressed portion 901 from the surface of the glass substrate 90. As shown in the area (c) of FIG. 10, a photocathode terminal 92 corresponding to the photocathode terminal 21 in FIG. 2 is inserted into the hole 902 to be fixed, and a photocathode 91 is formed in the depressed portion 901.

The silicon substrate 50 and the glass substrate 80 which have been made to progress up to the process of the area (a) of FIG. 10, and the glass substrate 90 which has been made to progress up to the process of the area (c) of FIG. 10 are joined in a vacuum-tight state as shown in the area (d) of FIG. 10. Thereafter, a photocathode side terminal 81 corresponding to the photocathode side terminal 41 in FIG. 2 is inserted into the hole 801 to be fixed, an anode terminal 82 corresponding to the anode terminal 42 in FIG. 2 is inserted into the hole 802 to be fixed, and control electrode terminals 83 corresponding to the control electrode terminals 43 in FIG. 2 are inserted into the holes 803 (not shown) to be fixed, respectively, which leads to a state shown in the area (e) of FIG. 10. Thereafter, due to this being cut out in units of chips, a photomultiplier having a configuration as shown in FIG. 1 and FIG. 2 can be obtained.

Figure 11:
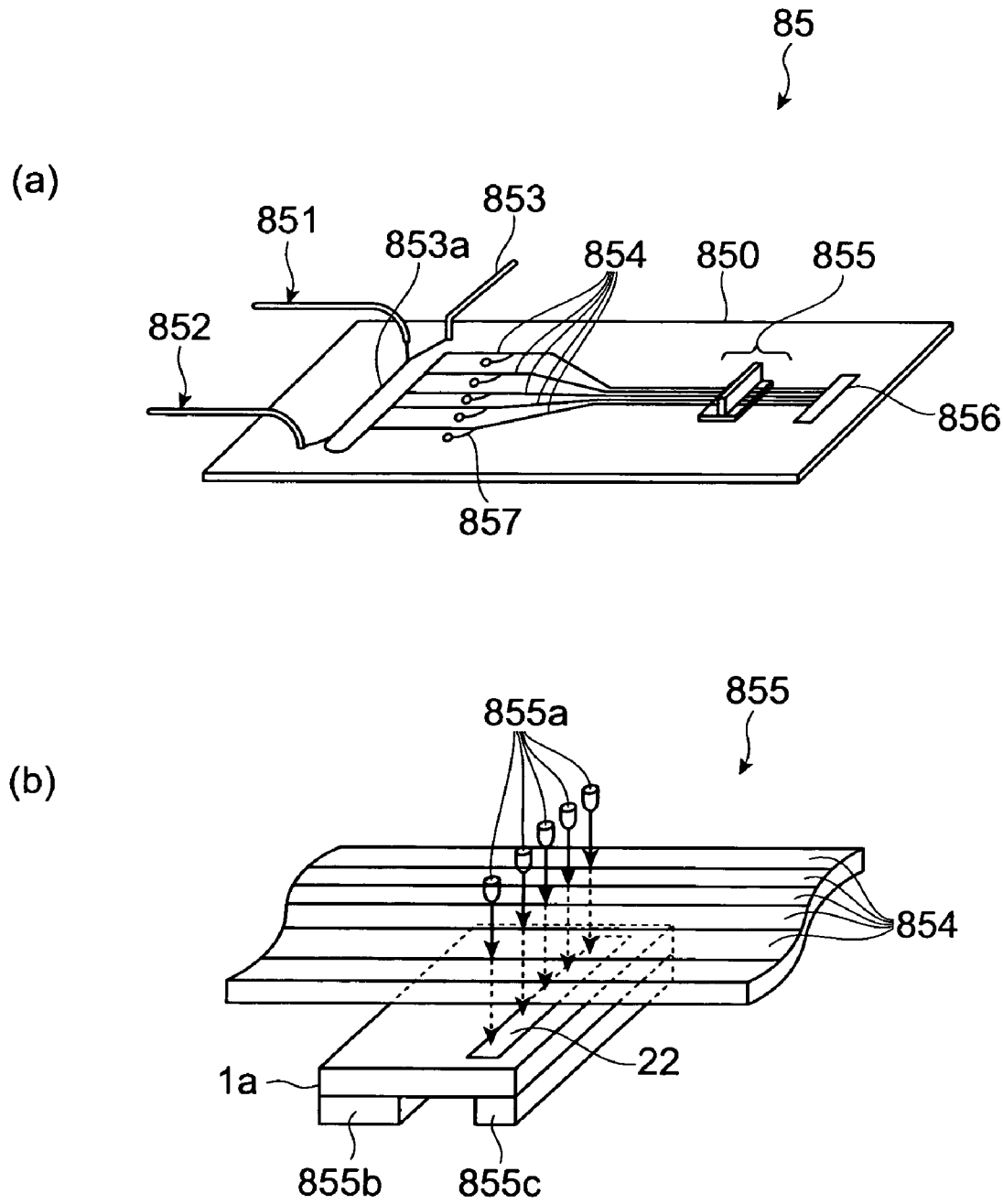
FIG. 11 illustrates diagrams showing configurations of a detection module to which the photomultiplier according to the present invention is applied.

Next, an optical module to which the photomultiplier 1*a* having a configuration as described above is applied will be described. The area (a) shown in FIG. 11 is a view showing a configuration of an analysis module to which the photomultiplier 1*a* has been applied. An analysis module 85 includes a glass plate 850, a gas inlet pipe 851, a gas exhaust pipe 852, a solvent inlet pipe 853, reagent mixing-reaction paths 854, a detecting element 855, a waste liquid pool 856, and reagent paths 857. The gas inlet pipe 851 and the gas exhaust pipe 852 are provided to introduce or exhaust a gas serving as an object to be analyzed to or from the analysis module 85. The gas introduced from the gas inlet pipe 851 passes through an extraction path 853*a* formed on the glass plate 850, and is exhausted to the outside from the gas exhaust pipe 852. That is, by making a solvent introduced from the solvent inlet pipe 853 pass through the extraction path 853*a*, when there is a specific material of interest (for example, environmental hormones or fine particles) in the introduced gas, it is possible to extract it in the solvent.

The solvent which has passed through the extraction path 853*a* is introduced into the reagent mixing-reaction paths 854 so as to include the extract material of interest. There are a plurality of the reagent mixing-reaction paths 854, and due to corresponding reagents being introduced into the respective paths from the reagent paths 857, the reagents are mixed into the solvent. The solvent into which the reagents have been mixed travels toward the detecting element 855 through the reagent mixing-reaction paths 854 while carrying out reactions. The solvent in which detection of the material of interest has been completed in the detecting element 855 is discarded to the waste liquid pool 856.

A configuration of the detecting element 855 will be described with reference to the area (b) shown in FIG. 11. The detecting element 855 comprises a light-emitting diode array 855*a*, the photomultiplier 1*a*, a power supply 855*c*, and an output circuit 855*b*. In the light-emitting diode array 855*a*, a plurality of light-emitting diodes are provided to correspond to the respective reagent mixing-reaction paths 854 of the glass plate 850. Pumping lightwaves (solid line arrows in the figure) emitted from the light-emitting diode array 855*a* are guided into the reagent mixing-reaction paths 854. The solvent in which a material of interest can be included is made to flow in the reagent mixing-reaction paths 854, and after the material of interest reacts to the reagent in the reagent mixing-reaction paths 854, pumping lightwaves are irradiated onto the reagent mixing-reaction paths 854 corresponding to the detecting element 855, and fluorescence or transmitted light (broken-line arrows in the figure) reach the photomultiplier 1*a*. This fluorescence or transmitted light is irradiated onto the photocathode 22 of the photomultiplier 1*a*.

As described above, because the electron-multiplier section having a plurality of grooves (for example, in number corresponding to twenty channels) is provided to the photomultiplier 1*a*, it is possible to detect from which position (from which reagent mixing-reaction path 854) fluorescence or transmitted light has changed. This detected result is outputted from the output circuit 855*b*. Furthermore, the power supply 855*c* is a power supply for driving the photomultiplier 1*a*. Note that, a glass substrate (not shown) is disposed on the glass plate 850, and covers the extraction path 853*a*, the reagent mixing-reaction paths 854, the reagent paths 857 (except for the sample injecting portions) except for the contact portions between the gas inlet pipe 851, the gas exhaust pipe 852, and the solvent inlet pipe 853, and the glass plate 850, the waste liquid pool 856, and sample injecting portions of the reagent paths 857.

As described above, in accordance with the present invention, control electrodes electrically connected to the wiring parts extending from the electron emission terminal in the electron-multiplier section are further provided, and a voltage, instead of the applying between the electron entrance terminal and the electron emission terminal, is applied between the electron entrance terminal and the control electrodes, which makes it possible for an electric potential at the electron emission terminal to be lower than that in the conventional art in a state in which an electric potential gradient in the electron-multiplier section is formed. As a result, it is possible to provide a sufficient electric potential difference between the electron emission terminal in the electron-multiplier section and the anode, which makes it possible to effectively guide secondary electrons cascade-multiplied in the electron-multiplier section (stable detection accuracy can be obtained).

Furthermore, by providing the protruding portions 311*a* having a desired height on the surfaces of the wall parts 311 defining the groove portions of the electron-multiplier section 31, it is possible to dramatically improve the electron-multiplication efficiency.

In addition, because the grooves are formed in the electron-multiplier section 31 by performing microfabrication onto the silicon substrate 30*a*, and the silicon substrate 30*a* is joined to the glass substrate 40*a*, there is no vibratory portion. That is, the photomultiplier according to the respective embodiments is excellent in vibration resistance and impact resistance.

Because the anode 32 is joined to the glass substrate 40*a*, there is no metal droplet at the time of welding. Therefore, the photomultiplier according to the respective embodiments is improved in electrical stability, vibration resistance, and impact resistance. Because the anode 32 is joined to the glass substrate 40*a* at the entire bottom face thereof, the anode 32 does not vibrate due to impact or vibration. Therefore, the photomultiplier is improved in vibration resistance and impact resistance.

In addition, in the manufacture of the photomultiplier, because there is no need to assemble the internal configuration, and handling thereof is simple and work hours are shortened. Because the housing (vacuum case) composed of the upper frame 2, the sidewall frame 3, and the lower frame 4, and the internal configuration are integrally built, it is possible to easily downsize the photomultiplier. Since there are no separate components internally, electrical and mechanical joining is not required.

In the electron-multiplier section 31, cascade-multiplication of electrons is carried out while electrons collide against the sidewalls of the plurality of grooves formed by the wall parts 311. Therefore, because the configuration is simple and a large number of components are not required, it is possible to easily downsize the photomultiplier.

In accordance with the analysis module 85 to which the photomultiplier having a configuration as described above is applied, it is possible to detect minute particles. Furthermore, it is possible to continuously carry out extraction, reaction, and detection.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The electron-multiplier tube according to the present invention can be applied to various fields of detection requiring detection of low light.

The invention claimed is:

1. A photomultiplier, comprising:

a housing having a vacuum inner space maintained in a vacuum state, said housing having a device mount surface serving as one of inner walls defining said vacuum inner space;

a photocathode, accommodated in said housing, emitting electrons to the inside of said housing in response to light taken in via said housing;

an electron-multiplier section, disposed on said device mount surface of said housing, having dynode channels respectively defined by spaces each extending along an electron traveling direction, the electron-multiplier section having an electron emission terminal;

an anode, disposed on said device mount surface of said housing, taking out, as signals, electrons having reached among electrons cascade-multiplied in said electron-multiplier section;

a control electrode disposed on said device mount surface of said housing while being electrically separated from said anode, the control electrode provides a sufficient electric potential difference between the electron emission terminal of the electron-multiplier section and the anode, and a wiring part disposed on said device mount surface of said housing while being electrically separated from said anode, said wiring part having one end connected to said control electrode and the other end connected to said electron emission terminal of said electron-multiplier section, wherein said electron-multiplier section, said anode, said control electrode, and said wiring part are disposed in said vacuum inner space of said housing.

2. A photomultiplier according to claim 1, wherein said anode is disposed between said electron emission terminal of said electron-multiplier section and said control electrode.

3. A photomultiplier according to claim 1, wherein an electric potential of said control electrode is set to be higher than an electric potential of said electron emission terminal of said electron-multiplier section, but to be equal to or less than an electric potential of said anode.

4. A photomultiplier according to claim 1, wherein said control electrode is comprised of silicon.

5. A photomultiplier according to claim 1, wherein said anode and said control electrode are disposed at the same side with respect to said electron emission terminal of said electron-multiplier section, and wherein a distance between said electron emission terminal and a surface of said control electrode which faces said electron emission terminal is longer than a distance between said electron emission terminal and a surface of said anode which faces said electron emission terminal.

6. A photomultiplier according to claim 1, wherein said control electrode is disposed at an opposite side of said anode with respect to said electron emission terminal of said electron-multiplier section.

7. A photomultiplier according to claim 1, wherein said control electrode is set to a voltage higher than that of an electron emission terminal of said electron-multiplier section from which the cascade-multiplied electrons are emitted.

8. A photomultiplier according to claim 1, wherein said wiring part has a portion extending along the electron traveling direction.

* * * * *